US005666130A

United States Patent [19]

Williams et al.

[11] Patent Number: 5,666,130

[45] Date of Patent: Sep. 9, 1997

[54] POINT ADDRESSABLE DISPLAY ASSEMBLY, METHOD OF OPERATING SAME, AND METHOD OF FABRICATING SAME

[75] Inventors: Ronald L. Williams, San Marcos; Ronald M. Finnila, Carlsbad, both of Calif.

[73] Assignee: Hughes Aircraft Company, Los Angeles, Calif.

[21] Appl. No.: 288,375

[22] Filed: Aug. 10, 1994

[51] Int. Cl.[6] ..... G09G 3/36

[52] U.S. Cl. ..... 345/90; 345/92

[58] Field of Search ..... 345/89, 90, 91, 345/92, 93, 205, 206; 359/57, 58, 59; 348/790, 792

[56] References Cited

U.S. PATENT DOCUMENTS

| | | | |
|---|---|---|---|
| 4,651,149 | 3/1987 | Takeda et al. | 345/90 |
| 4,870,396 | 9/1989 | Shields | 345/90 |
| 5,204,659 | 4/1993 | Sarma | 345/89 |
| 5,448,258 | 9/1995 | Edwards | 345/90 |

*Primary Examiner*—Regina D. Liang

*Attorney, Agent, or Firm*—M. E. Lachman; M. W. Sales; W. K. Denson-Low

[57] ABSTRACT

A method of operating a liquid crystal display, and a liquid crystal display constructed to operate in accordance with the method. The liquid crystal display has a plurality of display pixels, and the method comprises the steps of (a) operating a first switch (S1) for storing a charge on a storage capacitance (C1), the charge having a magnitude selected so as to cause a desired degree of polarization of a region (pixel) of liquid crystal material; (b) operating a second switch (S2) so as to conductively couple the stored charge to the region of liquid crystal material, thereby storing a charge on a capacitance (C2) that is associated with the region of liquid crystal material; and (c) operating a third switch (S3) so as to discharge the storage capacitance and the capacitance that is associated with the region of liquid crystal material. Also disclosed is a method of fabricating a display assembly that comprises a layer of liquid crystal material and a plurality of drive circuits that are formed within a common layer of semiconductor material.

5 Claims, 2 Drawing Sheets

POINT ADDRESSABLE DISPLAY ASSEMBLY, METHOD OF OPERATING SAME, AND METHOD OF FABRICATING SAME

FIELD OF THE INVENTION

This invention relates generally to display apparatus and, in particular, to liquid crystal displays and circuitry for energizing the display pixels.

BACKGROUND OF THE INVENTION

Conventional liquid crystal displays (LCDs) exhibit renewal, refresh and sequential loading constraints that are reflected in the overall design of the display. In particular, it is typically required that the external pixel drive electronics be tailored to the specific requirements of the selected liquid crystal material.

For projection type systems that employ a multi-pixel LCD component it is often the case that the liquid crystal material is selected to have a relatively slow response time so as to be compatible with the drive (write) electronics. As a result, the reaction time of the display is compromised by the requirements of the external circuitry that drives the display.

OBJECTS OF THE INVENTION

It is therefore an object of this invention to provide a display assembly that overcomes the foregoing and other problems.

It is a further object of this invention to provide a novel LCD drive circuit that serves to decouple the speed of the drive electronics from the characteristics of the liquid crystal material, thereby enabling each to be separately optimized for a given application.

It is another object of this invention to provide a method for fabricating a hybrid LCD/drive circuit assembly that employs bonded silicon wafer technology.

SUMMARY OF THE INVENTION

The foregoing and other problems are overcome and the objects of the invention are realized by a method of operating a liquid crystal display, and by a liquid crystal display constructed to operate in accordance with the method. The liquid crystal display has a plurality of display pixels, and the method comprises the steps of (a) storing a charge on a storage capacitance, the charge having a magnitude selected so as to cause a desired degree of polarization of a region of liquid crystal material; (b) operating a first switch so as to conductively couple the stored charge to the region of liquid crystal material, thereby storing a charge on a capacitance that is associated with the region of liquid crystal material; and (c) operating a second switch so as to discharge the storage capacitance and the capacitance that is associated with the region of liquid crystal material.

The liquid crystal display is preferably organized as a plurality of rows and columns of discrete display pixels, and the step of storing selectively stores the charge for individual ones of the rows of a column. The step of operating the first switch is accomplished so as to couple the charge for each of the rows of the column simultaneously to the corresponding pixels of the column.

Further in accordance with this invention there is provided a method for fabricating a display assembly, comprising the steps of (a) providing a first structure comprised of a first substrate having a layer of semiconductor material disposed on a surface thereof; (b) forming a plurality of display drive circuits in a first, exposed surface of the layer of semiconductor material; (c) mounting the first structure to a second substrate such that the layer of semiconductor material is interposed between the first substrate and the second substrate; (d) removing the first substrate; (e) forming electrical interconnections through the layer of semiconductor material from a second surface that is opposite the first surface so as to conductively contact the drive circuits; and (g) electrically connecting a display device capable of having a plurality of pixel regions to the electrical interconnections such that individual ones of the plurality of display drive circuits are electrically coupled to at least one pixel region.

In a preferred embodiment of this invention the display device includes a layer of liquid crystal material.

The step of removing the first substrate includes a step of chemically etching at least a portion of the first substrate.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
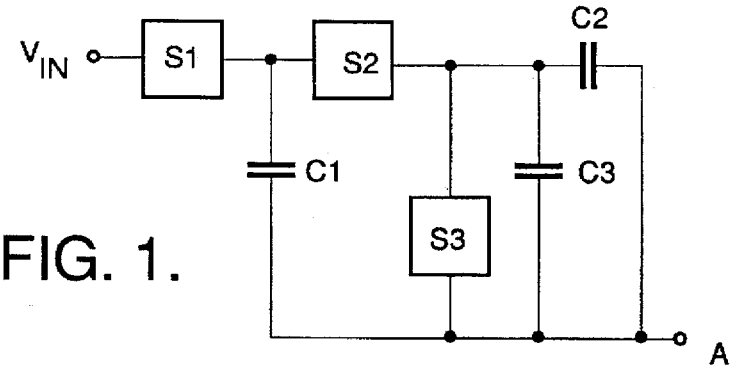
FIG. 1 is a simplified schematic diagram of a single LCD pixel and a drive circuit therefor in accordance with this invention.

Referring now to FIG. 1 there is illustrated a simplified schematic diagram of a single LCD pixel and the drive circuit therefor in accordance with this invention. The capacitance C2 represents the liquid crystal pixel. S1 represents a point write gate, and may be implemented either as a transistor switch, when the liquid crystal pixel is driven with a voltage $V_{IN}$, from an external circuit, or as a photo-activated charge source, when the liquid crystal pixel is driven optically. The capacitance C1 is a write storage capacitor and has a charge impressed thereon by the action of S1. The capacitance C3 is an optional additional storage capacitance. The need for C3 is dictated by the characteristics of the selected liquid crystal material. S2 represents a transistor write gate (switch) that serves, when closed, to impress the stored charge from C1 onto C2. This causes the liquid crystal pixel to become polarized and to become visually distinct, in a well known and conventional manner. S3 is a transistor switch that is used to reinitialize the liquid crystal material to an unpolarized state. S3, when closed, drains the charge to the point "A" from C1, C2 and, if present, from C3.

In operation, writing of the pixel occurs by applying charge on C1 through S1. When all of the required pixels of the array are so loaded, S2 is closed to transfer the charge from C1 to C2. This causes the liquid crystal dielectric material (C2) to polarize, and also stores charge in C3 (if present). C2 remains polarized until S3 is switched, which then discharges C1, C2 and C3 and turns the pixel off. A back-bias can be applied at point "A" to cause a more rapid turn-off of the liquid crystal pixel (C2).

By example, for a 25 micron square liquid crystal pixel C2 has a capacitance of approximately 25 femtofarads (ff). In that C1 must dump enough charge into C2 to polarize the liquid crystal dielectric material, the capacitance of C1 is preferably equal to or greater than the capacitance of C2 (e.g., 25 pf to 27 ff). The potential of the back-bias that is optionally applied at point "A" is selected to rapidly remove the charge on C2. By example, the back-bias potential may be 0.01 volts.

Figure 2:
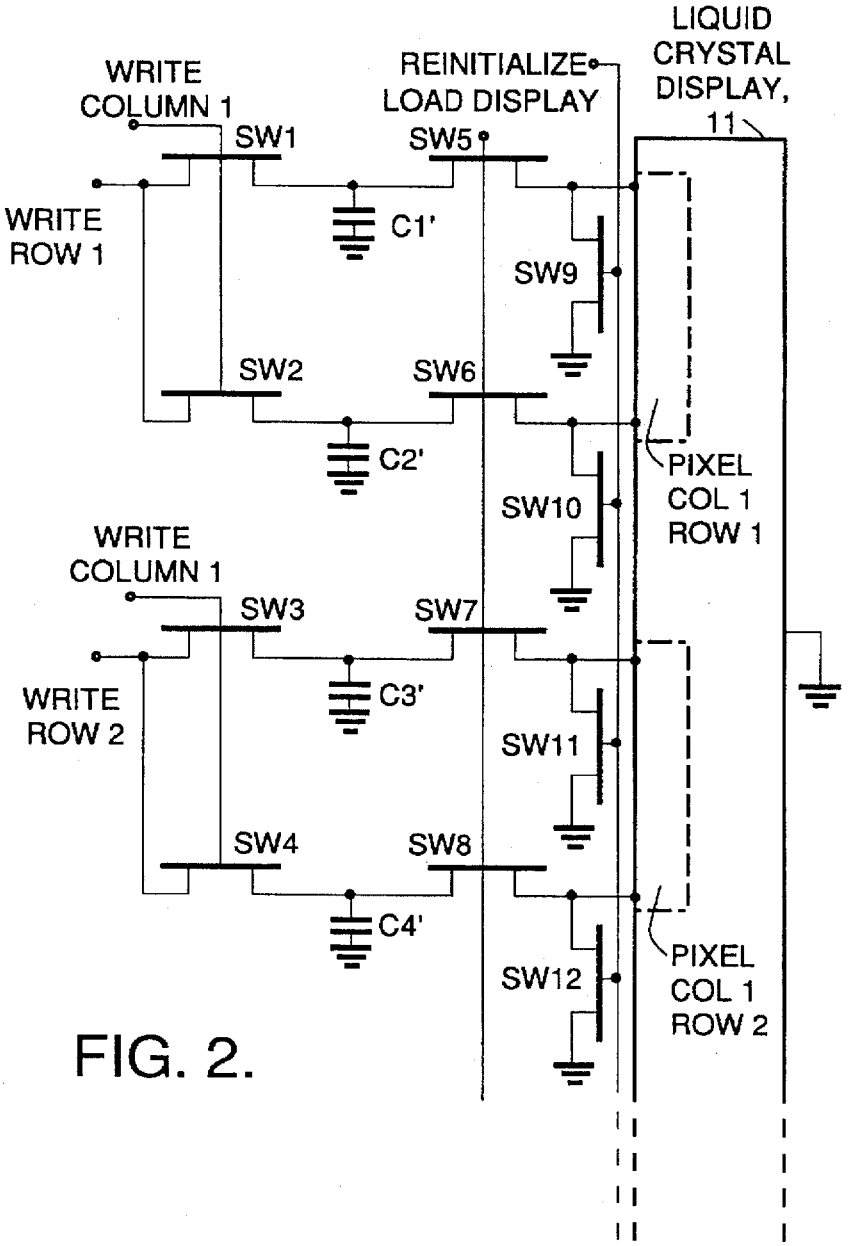
FIG. 2 is a schematic diagram showing a portion of an LCD display and the associated drive circuits in accordance with this invention.

FIG. 2 illustrates a portion of a display system 10 and, in particular, an LCD 11 that is organized as rows and columns, and the drive electronics for writing a portion of the LCD, specifically the pixels in column 1, rows 1 and 2. The circuitry is provided in a redundant, parallel manner so that there are two write gate switches (SW1 and SW2, each corresponding to S1 in FIG. 1) and two write storage capacitors (C1' and C2') for the pixel at column 1, row 1, two write gate switches (SW3 and SW4) and two write storage capacitors (C3' and C4') for the pixel at column 1, row 2, etc. The write gate switch S2 of FIG. 1 is also redundantly provided as SW5 and SW6, for C1' and C2' and as SW7 and SW8, for C3' and C4'. The reinitialize switch S3 of FIG. 1 is correspondingly provided in a redundant manner as SW9, SW10 and as SW11, SW12. C2 in FIG. 1 corresponds to the liquid crystal material within the corresponding pixels of the LCD 11. The optional storage capacitor C3 is not employed in the embodiment of FIG. 2. The circuit configuration for a single pixel is duplicated as required for the pixels of each row and column of the LCD 11.

To perform a single write cycle the Write Column 1 signals are simultaneously activated to selectively turn on SW1–SW4. The Write Row 1, Write Row 2, etc., signals are then energized, either sequentially or parallel, so as to apply a potential through SW1–SW4 that is proportional to the degree of polarization that is required to exhibit a desired, shade of gray (between "white" and "black") in the liquid crystal material of the corresponding pixels. The Write Column 1 signal(s) are then de-energized to turn off the transistor switches SW1–SW4. At this time charge is stored on C1'–C4', but not yet applied to the liquid crystal pixels. Next, the Load Display signal is energized to turn on transistor switches SW5–SW8, thereby transferring the charge on C1'–C4' to the capacitances of the liquid crystal pixels. This causes the desired degree of polarization of the liquid crystal material. After a period of time suitable for causing the polarization of the selected liquid crystal material, and with the Load Display signal still energized, the Reinitialize signal is energized to discharge C1'–C4' and the corresponding capacitance of the pixels of the LCD 11. The Load Display and Reinitialize signals are then de-energized to complete the column 1 write cycle.

It should be appreciated that this technique effectively decouples the pixel write timing (Write Column and Write Row signals) from the timing requirements of the selected liquid crystal material. That is, the charges corresponding to the desired write potentials are first stored onto the capacitors C1'–C4', after which the charges are transferred into the LCD 11 by the application of the Load Display signal. This enables the two subsystems (write circuitry and LCD) to be separately specified and optimized.

This technique furthermore enables discrete areas of pixels to be separately written to, where each area may comprise from one to n pixels, where n is equal to the total number of pixels of the LCD 11.

Reference is now made to FIGS. 3A–3D for illustrating a presently preferred method for fabricating the display system 10.

Figure 3A:
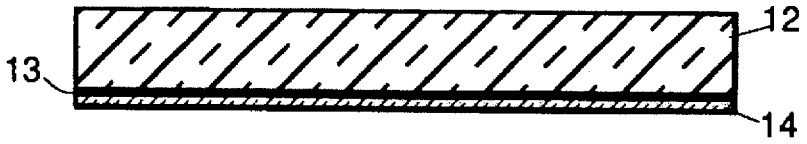
FIGS. 3A–3D are each a simplified cross-sectional view illustrating a method of fabricating an LCD assembly in accordance with an aspect of this invention.

Processing begins in FIG. 3A with a thinned silicon-on-insulator (SOI) wafer comprised of a substrate 12, an insulating dielectric layer ($SiO_2$) 13, and a thin silicon <100> active device layer 14. By example, the substrate 12 has a thickness of approximately 500 micrometers, the $SiO_2$ dielectric layer 13 a thickness of approximately 10,000 Angstroms, and the silicon film layer 14 has a thickness within a range of approximately 2 micrometers to approximately 50 micrometers. Bonded silicon structures having these characteristics are commercially available, or may be fabricated using known techniques.

The circuitry shown in FIG. 2 is then fabricated within the silicon layer 14 using conventional integrated circuit fabrication techniques.

Figure 3B:
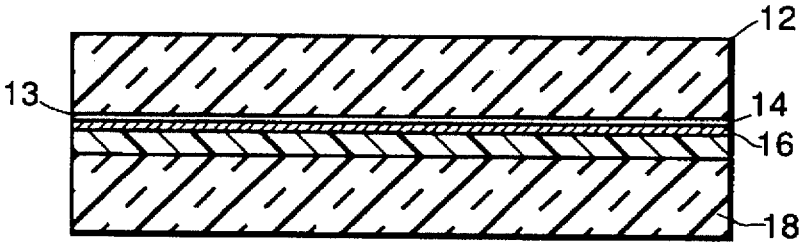

In FIG. 3B the assembly of FIG. 3A is bonded, using a layer of epoxy 16, to a carrier substrate 18. By example, the carrier substrate 18 can be comprised of sapphire or any suitable material having a required mechanical stiffness and a dielectric characteristic that makes it electrically insulating. The structure is then further processed to remove the silicon substrate 12. This can be accomplished by a wet chemical etch using, by example, a solution of KOH. The $SiO_2$ layer 13 beneficially serves as an etch stop when KOH is used as the etchant. Alternately, the bulk of the silicon substrate 12 can be mechanically removed, such as by diamond point turning. For this latter case it may also be desirable to remove the remaining fraction of the silicon material with the chemical etch.

Figure 3C:
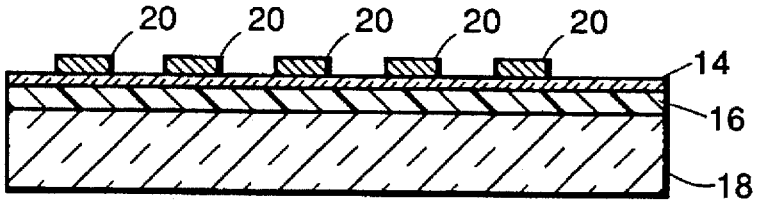

The resulting thinned structure is illustrated in FIG. 3C.

A next step etches vias (feedthroughs) through the exposed "backside" surface of the silicon layer 14 to contact the circuitry that was fabricated previously. The etched via holes are then filled with an electrically conductive material so as to provide an electrically conductive pathway from the active circuitry to the desired connection points of the liquid crystal display, and also to any required external circuit connection points. The external circuit connection points are employed to interface to the activating signals (i.e., Write Column, Write Row, Load Display, and the Reinitialize signals of FIG. 2). Electrically conductive pads 20 are then selectively formed on the "backside" surface of the silicon layer 14 so as to electrically contact the vias.

Figure 3D:
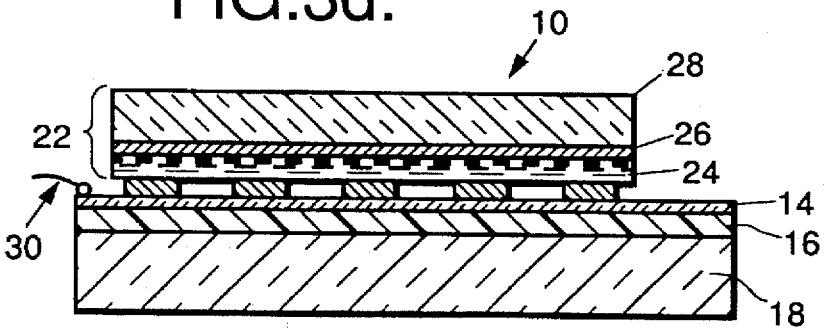

FIG. 3D shows an LCD assembly 22 that is connected to the pads 20 so as to electrically couple the individual display pixels to the corresponding drive circuits that are formed within the silicon layer 14. The LCD assembly 22 includes a layer 24 of the liquid crystal material, an electrically conductive and substantially transparent layer 26 (preferably comprised of Indium Tin Oxide), and a protective transparent layer 28, such as glass. The display is viewed through the layers 26 and 28. The electrically conductive pads 20 also function as reflectors for the overlying liquid crystal material.

The layer 26 electrically corresponds to the point "A" shown in FIG. 1 and is employed as a common electrode for each of the LCD pixels. If used, the back-bias potential is also coupled to the layer 26. This implies the use of separate common potentials for the switches SW9–SW12 and the storage capacitors C1'–C4' in FIG. 2.

The display assembly is completed by forming the required connections, such as wirebonds 30, for interfacing the display assembly 10 to interface pads, pins, or directly to external circuitry.

It should be realized that the provision of parallel redundant drive circuits per pixel is beneficial in improving the yield of the resulting display assembly, but is not required to practice this invention. When redundant circuits are used a laser can be used to selectively disable a defective circuit prior to connecting the LCD assembly 22 to the conductive pads 20.

Although this invention has been described in the context of specific materials, electrical values and dimensions, it is to be understood that the description is not to be construed to limit the practice of this invention to only these materials, values and dimensions.

Thus, while the invention has been particularly shown and described with respect to a preferred embodiment thereof, it will be understood by those skilled in the art that changes in form and details may be made therein without departing from the scope and spirit of the invention.

What is claimed is:

1. A display assembly comprising:

a layer of liquid crystal material; and a plurality of liquid crystal drive circuits individual ones of which are electrically coupled to at least one region of said liquid crystal material, each of said regions being a display pixel having an associated pixel capacitance, each of said plurality of liquid crystal drive circuits comprising, at least one storage capacitance having a first node and a second node that is coupled to a first common potential;

first switch means coupled to the first node for selectively charging said at least one storage capacitance;

second switch means having an input node coupled to the first node and an output node coupled to one of said display pixels for selectively coupling said at least one storage capacitance to said pixel; and third switch means coupled from said output node to a second common potential for selectively discharging said at least one storage capacitance and said pixel capacitance wherein said second common potential differs from said first common potential and is selected so as to accelerate the discharging of said storage capacitance and said pixel capacitance.

2. A display assembly as set forth in claim 1 wherein said plurality of liquid crystal drive circuits are fabricated within a common layer of semiconductor material.

3. A display assembly as set forth in claim 1 wherein said second common potential is applied through a substantially transparent layer of electrically conductive material.

4. A display assembly as set forth in claim 1 wherein said first switch means is electrically activated.

5. A display assembly as set forth in claim 1 wherein said first switch means is optically activated.

* * * * *